US009687899B2

(12) United States Patent
Wolf et al.

(10) Patent No.: US 9,687,899 B2
(45) Date of Patent: Jun. 27, 2017

(54) DEVICE FOR FORMING METALS

(71) Applicant: Allgaier Werke GmbH, Uhingen (DE)

(72) Inventors: Michael Wolf, Uhingen (DE); Matthias Mihm, Stuttgart (DE); Alexander Müller, Stuttgart (DE); Ottmar Lehr, Rechberghausen (DE)

(73) Assignee: Allgaier Werke GmbH, Uhingen (DE)

( * ) Notice: Subject to any disclaimer, the term of this patent is extended or adjusted under 35 U.S.C. 154(b) by 0 days.

(21) Appl. No.: 15/010,458

(22) Filed: Jan. 29, 2016

(65) Prior Publication Data

US 2016/0144416 A1 May 26, 2016

Related U.S. Application Data

(63) Continuation of application No. PCT/EP2014/065822, filed on Jul. 23, 2014.

(30) Foreign Application Priority Data

Jul. 31, 2013 (DE) ..... 10 2013 012 684

(51) Int. Cl.
*B21D 22/02* (2006.01)
*B21D 41/04* (2006.01)
(Continued)

(52) U.S. Cl.
CPC ..... *B21D 22/022* (2013.01); *B21D 5/008* (2013.01); *B21D 5/04* (2013.01); *B21D 19/088* (2013.01);
(Continued)

(58) Field of Classification Search
CPC ..... B21D 22/02; B21D 31/005; B21D 26/02; B21D 5/04; B21D 41/04; B21D 22/04;
(Continued)

(56) References Cited

U.S. PATENT DOCUMENTS 438,409 A * 10/1890 Dewey ..... B21D 41/04 219/149
1,251,578 A 1/1918 Riecken
(Continued)

FOREIGN PATENT DOCUMENTS

CN 201098711 Y 8/2008
DE 1 916 826 6/1965
(Continued)

OTHER PUBLICATIONS

Notice of Transfer of International Research Repot and the Written Notice Issued for International Searching Authority or Statement dated Sep. 29, 2014 for International Application No. PCT/EP2014/065822 (5 pages).
(Continued)

*Primary Examiner* — David B Jones
(74) *Attorney, Agent, or Firm* — Taylor IP, P.C.

(57) ABSTRACT

The invention relates to a device for processing a workpiece, said device including the following features: a punch on one side of the workpiece, a die on the opposite side of the workpiece, and a conductive electric heating system for generating an electric current that flows through the workpiece starting from a component situated on one side of the workpiece outside of the punch to a component situated on the opposite side of the workpiece outside of the die.

4 Claims, 4 Drawing Sheets

(51) Int. Cl.

| | |
|---|---|
| ***B21D 31/00*** | (2006.01) |
| ***B21D 5/04*** | (2006.01) |
| ***B21D 26/02*** | (2011.01) |
| ***B21D 22/04*** | (2006.01) |
| ***B21D 5/00*** | (2006.01) |
| ***B21D 19/08*** | (2006.01) |
| ***B21D 22/00*** | (2006.01) |
| ***B21D 37/16*** | (2006.01) |

(52) U.S. Cl.
CPC ..... *B21D 22/00* (2013.01); *B21D 22/04* (2013.01); *B21D 26/02* (2013.01); *B21D 31/005* (2013.01); *B21D 37/16* (2013.01); *B21D 41/04* (2013.01)

(58) Field of Classification Search
CPC ..... B21D 5/008; B21D 19/088; B21D 22/00; B21D 37/16
USPC ..... 72/345.1, 345.5, 342.1, 34.52
See application file for complete search history.

(56) References Cited

U.S. PATENT DOCUMENTS

| | | | | |
|---|---|---|---|---|
| 2,460,519 | A * | 2/1949 | Marchant | B21D 22/04 219/128 |
| 3,051,830 | A * | 8/1962 | Swain | B21D 41/04 219/149 |
| 4,532,793 | A | 8/1985 | Bezold | |
| 7,302,821 | B1 * | 12/2007 | Dariavach | B21D 5/04 219/152 |
| 7,516,640 | B2 * | 4/2009 | Golovashchenko | B21D 26/06 72/342.94 |
| 8,021,501 | B2 * | 9/2011 | Roth | B21D 31/005 148/566 |
| 2014/0311205 | A1 | 10/2014 | Banik et al. | |

FOREIGN PATENT DOCUMENTS

| | | | |
|---|---|---|---|
| DE | 198 58 060 | A1 | 9/2000 |
| DE | 101 07 545 | C1 | 4/2002 |
| DE | 10 2006 029 124 | B4 | 9/2009 |
| JP | 7-155856 | A | 6/1995 |
| JP | 2007-260761 | A | 10/2007 |
| JP | 2009-262184 | A | 11/2009 |
| WO | 2011/072847 | A1 | 6/2011 |

OTHER PUBLICATIONS

Notice of Transmittal of International Preliminary Report on Patentability dated Oct. 29, 2015 for International Application No. PCT/EP2014/065822 (18 pages).

* cited by examiner

DEVICE FOR FORMING METALS

CROSS REFERENCE TO RELATED APPLICATIONS

This is a continuation of PCT application No. PCT/EP2014/065822, entitled "DEVICE FOR FORMING METALS", filed Jul. 23, 2015, which is incorporated herein by reference.

BACKGROUND OF THE INVENTION

1. Field of the Invention

The invention relates to a device for forming metals, in particular forming of parts, such as the forming of a collar.

2. Description of the Related Art

The forming of a collar on a workpiece made of steel, for example a steel sheet plate made of the material of the plate, is an important topic. See DE 10 2006 029 124 B4 as well as DE 1 916 826, for example. The workpiece is placed on a die. The die includes a bore, which is adjacent to the workpiece. A hole is then pressed into the workpiece by means of a tipped punch while material is drawn into the die bore out of the sheet metal plane. As a result, a collar is formed which remains part of the workpiece. The above principle is particularly used in the automobile industry.

The described forming process involves stress to the workpiece within the forming zone. As such, mainly tensile stress take effect when raising the collar in the sheet metal edge. The reachable collar height is limited. The smaller the ratio between collar diameter to collar height, the higher is the risk of a breaking of the material in the collar region.

Forming failures are a big problem. Occasionally, this is not recognized before using the workpiece. Disassembly of defective parts and replacement with flawless parts is particularly complex in such a case.

It has already been attempted to optimize the drawing process by application of heat. For example, the punch can be heated in order to apply heat to the forming zone of the workpiece, e.g. the sheet metal plate. However, this provides the disadvantage that the punch loses its strength because it is heated and thus only has a short service life.

JP-A-2009262184 discloses a device which uses heat. By way of said device, a pot-type object is heated prior to a forming process. To that end, electrodes need to be advanced to the workpiece and then removed again in order to make room for advancing a tappet together with a punch. Processing is thus divided into two stages, which implies time effort.

JP-A-2007260761 describes a device which includes two electrodes for heating a steel sheet. When heating said sheet, first a tappet needs to be lifted and then lowered again after heating. This also requires time.

SUMMARY OF THE INVENTION

The present invention provides a device for forming a collar on a workpiece made of sheet metal, particularly on a sheet metal plate or the like, by way of which the forming process is improved and the risk of a break of the collar is reduced but at the same time the tool elements involved keep their strength. In particular, the device includes few components and performs the processing steps more rapidly than known devices.

The inventors have recognized that they need to search for a solution that involves heating the forming region of the workpiece, however not the tool, particularly the punch.

Thus, one had to search for a system according to the principle of "hot workpiece, cold tool".

The solution according to the present invention lies with the following:

- A sleeve is provided, which surrounds the punch and which consists of electrically well-conducting material.
- A counterholder insertable into the die bore is provided, which is made of a material that is also a good electric conductor.
- The counterholder can be displaced downward corresponding to the downward movement of the punch.
- The sleeve serves as a blank holder and simultaneously as an electrode.

In such a device, heating the punch is not effected, since the current is not guided through the punch but through the sleeve and the counterholder.

The present invention solves the underlying object in an advantageous manner:

- essentially only the workpiece is heated, also only in the forming region, thus focused on a narrow region. In contrast, the tool essentially remains cold.
- pre-cut parts and formed parts of high-strength thin sheet metal may be used, since the break risk when forming (drawing) the collar is reduced in the invention. This saves weight and costs as well.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrates embodiments of the invention, and such exemplifications are not to be construed as limiting the scope of the invention in any manner.

DETAILED DESCRIPTION OF THE INVENTION

Figure 1:
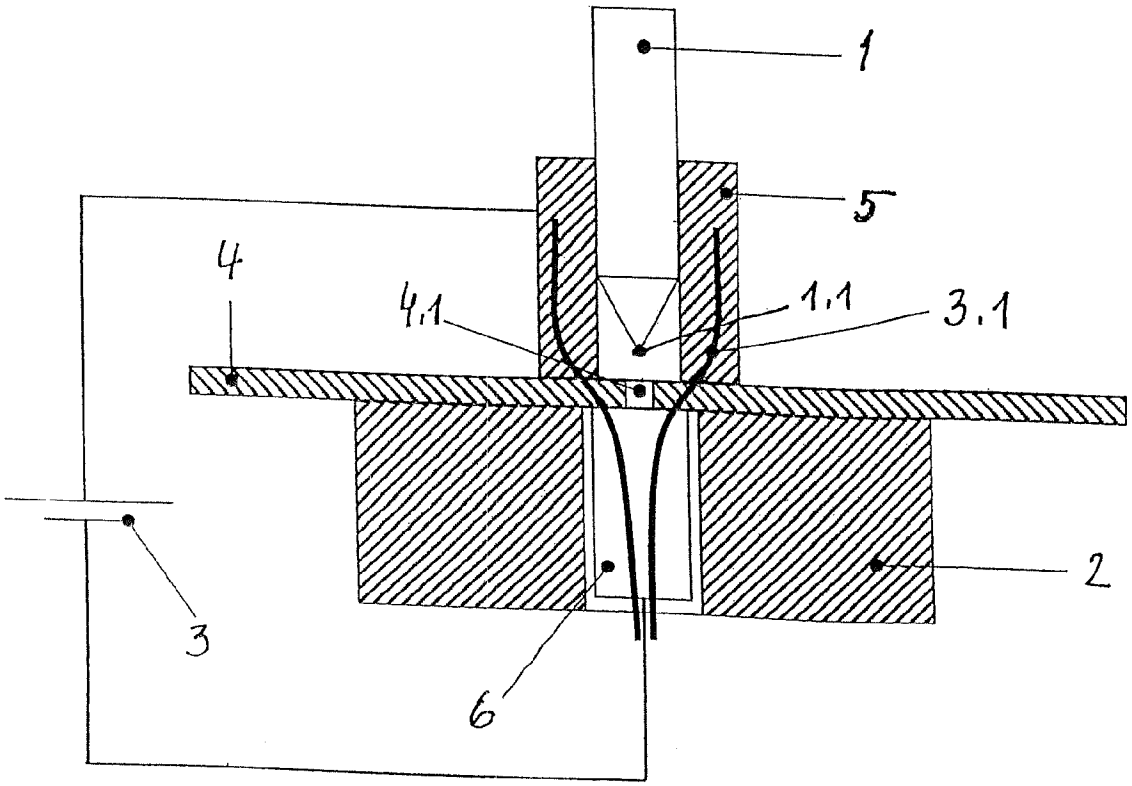
FIG. 1 shows a device according to the invention with a punch, a die and a workpiece, a sleeve surrounding the punch, and a counterholder in the die.

Referring now to FIG. 1, the illustrated device includes a punch 1 as well as a die 2. Further included is a conductive electric heating system with a power supply 3. Punch 1 is surrounded by a sleeve-shaped blank holder 5. A sheet metal plate 4 made of high-strength steel is placed on the die 2.

The punch 1 consists of a high-strength material. The punch 1 includes a tip 1.1. Said tip penetrates a bore 4.1 in the sheet metal plate 4. The bore may have been formed in the sheet metal plate 4 prior to the forming process. However, it is also possible for the sheet metal plate 4 to not have a bore, so that only the punch 1 forms the bore when impressing the sheet metal plate 4. The punch 1 may also be blunt. The shape of the front punch end may also be adapted to the requirements of the forming process. Punch 1 is surrounded by a blank holder 5.

As illustrated, there is a current flow 3.1, starting from the electric power source 3 through the electrically well-conductive blank holder 5, further through a certain forming region of the sheet metal plate 4 and then to a counterholder 6 which consists of an electrically well-conducting material such as copper.

In the illustration according to FIG. 1, the forming process is in an initial stage. Upon completion of the forming process, the bore 4.1 is widened in order to have the shape of the desired collar—not shown here. Then, the collar has an interior width that is equal to the diameter of the punch 1. This can be seen in FIG. 4.

Blank holder 5 has three functions at once. On the one side, it serves as a blank holder, on the other side as a current conductor, and finally as a stripper.

Punch 1 is completely free of current flow and is thus not actively heated. Thus it may be a tool steel of common quality, or hot-work steel. An air gap may be present between the punch 1 and the blank holder 5. However, this is not obligatory.

There is no need for the blank holder 5 to have a great strength. It may be made of copper. In any case, it should consist of an electrically well-conducting material. The same applies to the counterholder 6.

In this case, the material of the die 2 is insignificant. It may be any material—steel or copper, preferably however a less heat-conducting material so that the heat generated by the current remains restricted to the actual forming region.

Figure 2:
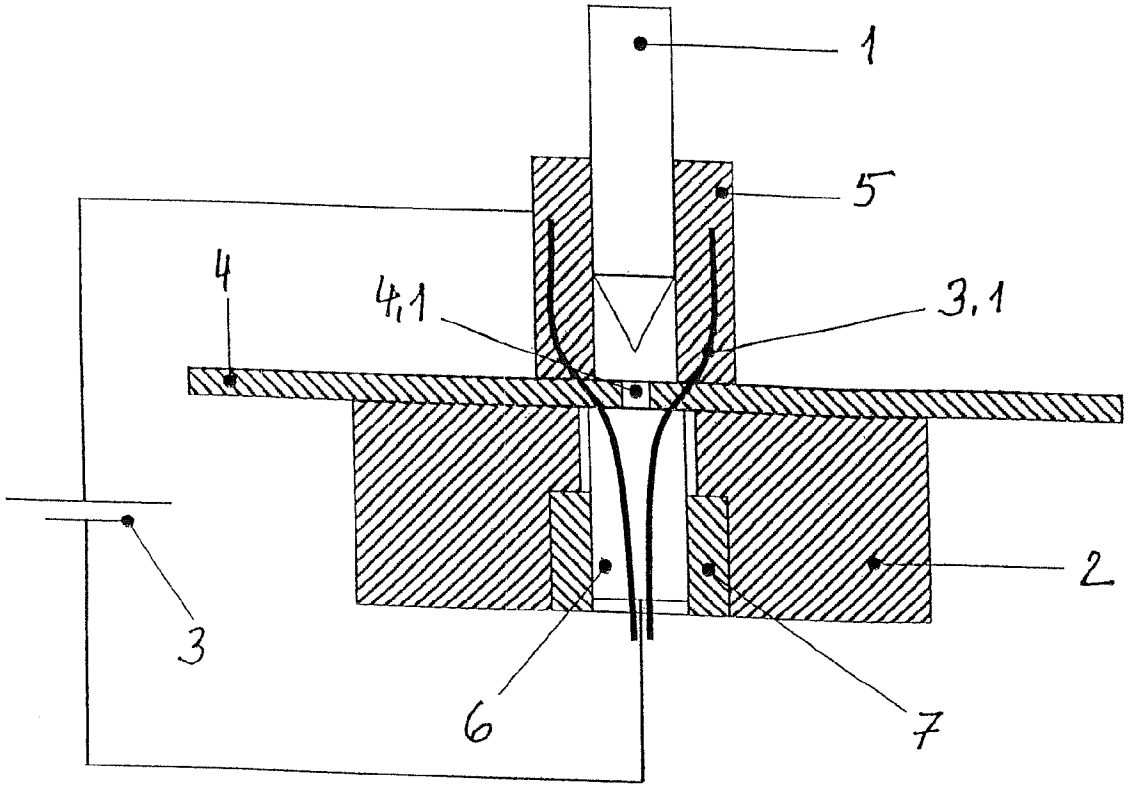
FIG. 2 shows an alternate embodiment of the device of FIG. 1.

The alternate embodiment of FIG. 2 again shows the punch 1, die 2, and sheet metal plate 4. Here, illustration and effect of an electric heating system are not discussed. Nevertheless, such a heating system is present. The significant component in FIG. 2 is an insulating coating 7. Said insulating coating 7 may be a sleeve or a coat.

The forming process is performed as follows: first, the sheet metal plate 4 is placed on the die 2. The blank holder 5 moves down and rests on the sheet metal plate 4 so that a current flow is activated and the forming zone is heated. Then, the punch 1 moves farther down and the blank holder 5 springs inward. Just before the punch touches the sheet metal plate 4, the power is switched off and the counterholder 6 is controlled away. The collar is raised while being formed.

Figure 3:
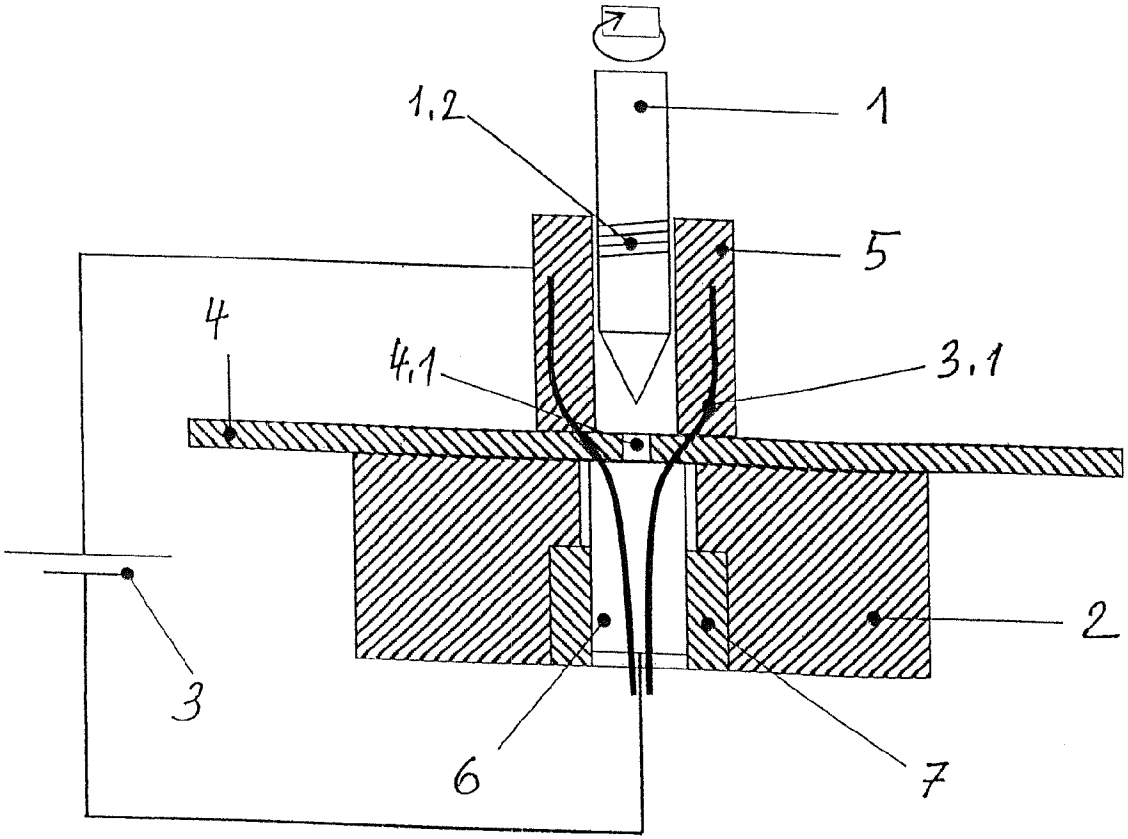
FIG. 3 shows another alternate embodiment of the device of FIG. 1.

The significant component in the alternate embodiment according to FIG. 3 is a thread molder 1.2 on the punch 1. Punch 1 is equipped with a schematically shown rotary drive. As it travels downward, punch 1 and thus the thread molder 1.2 are put in rotation. As a result, the developing collar (not shown) is formed with a thread through which a screw may be guided.

Figure 4:
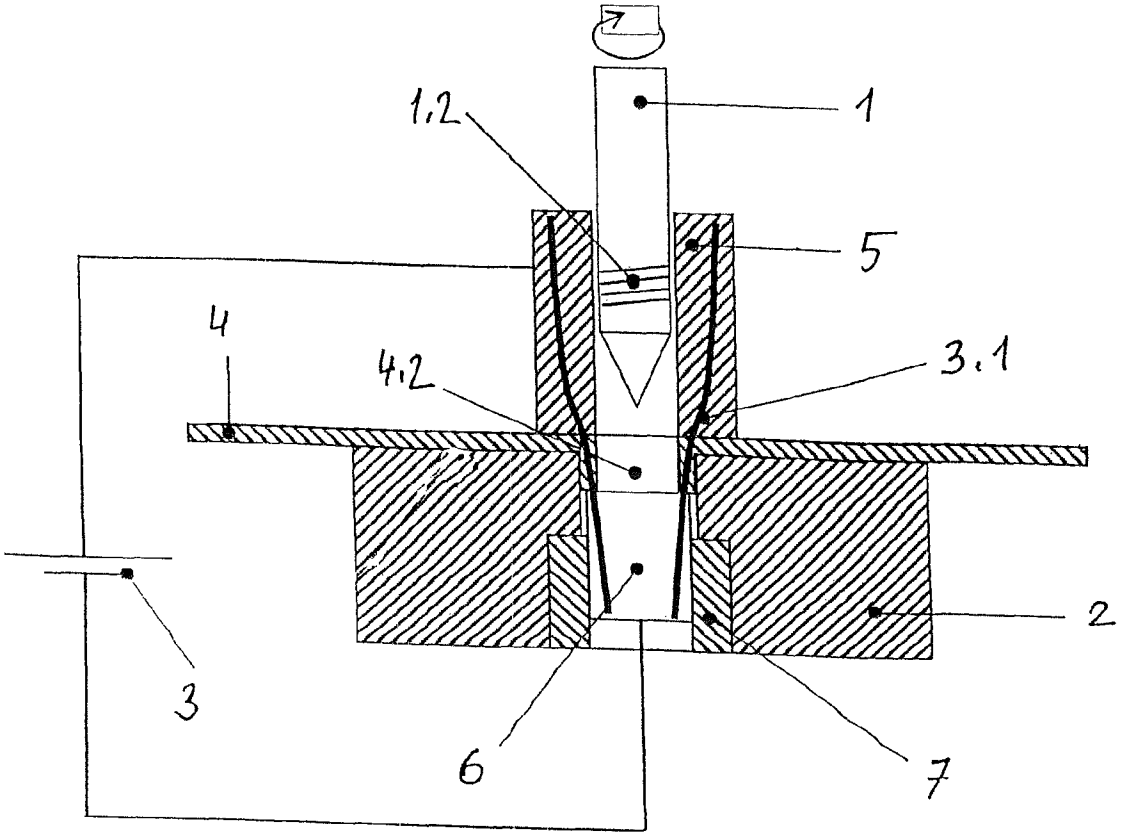
FIG. 4 illustrates the embodiments of FIGS. 2 and 3 after forming the collar.

As shown in FIG. 4, one may discern the collar 4.2 for the first time—being formed integrally with the remaining sheet metal plate 4. As illustrated, a thread molder 1.2 may again be discerned as in the embodiment according to FIG. 3, and an insulating coating 7 as in the embodiment according to FIG. 2.

If the forming capability of an existing collar for forming the thread is not sufficient, said collar may also actively be heated. For all embodiments described, either direct current (DC) or a low-frequency alternating current (AC) may be used for heating.

In all illustrations, individual elements of the device may be replaced by one another, e.g. the punch 1 and the die 2. The working direction of the punch is not limited to the vertical.

The basic idea underlying the invention is that exclusively or predominantly the workpiece is heated. In contrast, the tool is not heated, or heated only to a minor extent, so that its strength is reduced only insignificantly.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE NUMERAL LIST

1. punch
1.1 punch tip
1.2 thread molder
2. die
2.1 die bore
3 power source
3.1 current flow
4 sheet metal plate
4.1 bore
4.2 collar
5 blank holder
6 counterholder
7 insulating coating

What is claimed is:

1. A device for processing a workpiece, the device comprising:

a punch on one side of the workpiece;

a die on a side of the workpiece opposite the punch;

a first component situated on one side of the workpiece outside of the punch, the first component, a sleeve, is made of an electrically well-conducting material surrounding the punch and operable to be placed on the workpiece, the sleeve serving as a blank holder and at the same time as an electrode;

a second component situated within the die on an opposite side of the workpiece, the second component, a counterholder, is made of an electrically well-conducting material insertable into a bore of the die; and a conductive electric heating system operatively connected to said first component and said second component for generating an electric current which flows one of completely and predominantly through the workpiece, starting from the first component to the second component, thereby heating up the workpiece but not the punch.

2. A device for processing a workpiece, the device comprising:

a punch on one side of the workpiece;

a die on a side of the workpiece opposite the punch;

a first component situated on one side of the workpiece outside of the punch, the first component, a sleeve, is made of an electrically well-conducting material surrounding the punch and operable to be placed on the workpiece, the sleeve serving as a blank holder and at the same time as an electrode;

a second component situated within the die on an opposite side of the workpiece, the second component, a counterholder, is made of an electrically well-conducting material insertable into a bore of the die; and a conductive electric heating system operatively connected to said first component and said second component for generating an electric current which flows one of completely and predominantly through the workpiece, starting from the first component to the second component, wherein an inner face of the bore of the die is lined with at least one of an electrically insulating material and a heat insulating material.

3. A device for processing a workpiece, the device comprising:

a punch on one side of the workpiece;

a die on a side of the workpiece opposite the punch;

a first component situated on one side of the workpiece outside of the punch, the first component, a sleeve, is made of an electrically well-conducting material surrounding the punch and operable to be placed on the workpiece, the sleeve serving as a blank holder and at the same time as an electrode;

a second component situated within the die on an opposite side of the workpiece, the second component, a counterholder, is made of an electrically well-conducting material insertable into a bore of the die; and a conductive electric heating system operatively connected to said first component and said second component for generating an electric current which flows one of completely and predominantly through the workpiece, starting from the first component to the second component, wherein an inner face of the sleeve is lined with at least one of an electrically insulating material and a heat insulating material.

4. The device according to claim 3, wherein the device further includes a rotary drive that drives the punch around its longitudinal axis and includes a thread molder on said punch for forming a thread in an inner face of the workpiece.

* * * * *